US005422077A

United States Patent [19]

Bayer

[11] Patent Number: 5,422,077

[45] Date of Patent: Jun. 6, 1995

[54] REGENERATIVE BED INCINERATOR SYSTEM WITH GAS DOPING

[75] Inventor: Craig E. Bayer, Wellsville, N.Y.

[73] Assignee: Combusiton Engineering, Inc., Windsor, Conn.

[21] Appl. No.: 145,119

[22] Filed: Nov. 3, 1993

Related U.S. Application Data

[63] Continuation of Ser. No. 444,916, Dec. 4, 1989, abandoned.

[51] Int. Cl.[6] ..... B01D 53/36

[52] U.S. Cl. ..... 422/109; 422/173; 422/175; 422/177; 422/178; 422/111; 422/174; 431/5; 431/7; 431/170; 110/345; 110/245

[58] Field of Search ..... 422/173–178, 422/111, 109, 175, 171, 182–183; 432/120; 110/345, 245, 210–212, 203; 431/5, 170, 7

[56] References Cited

U.S. PATENT DOCUMENTS

| | | | |
|---|---|---|---|
| 3,870,474 | 3/1975 | Houston | 422/171 |
| 4,444,735 | 4/1984 | Birmingham et al. | 422/111 |
| 4,650,414 | 3/1987 | Grenfell | 422/173 |
| 4,741,690 | 5/1988 | Heed | 431/7 |
| 5,024,817 | 6/1991 | Mattison | 422/175 |
| 5,186,901 | 2/1993 | Bayer et al. | 422/177 |
| 5,188,804 | 2/1993 | Pace et al. | 422/111 |

*Primary Examiner*—Robert J. Warden
*Assistant Examiner*—Hien Tran
*Attorney, Agent, or Firm*—Arthur E. Fournier, Jr.

[57] ABSTRACT

A regenerative bed incinerator 10 is provided with a gas recirculation duct 80 through which a controlled amount of gaseous fuel is injected in the contaminated process exhaust gases 3 prior to admission to the regenerative bed incinerator 10 to increase the heating value of the process exhaust gases 3 so as to improve overall contaminated destruction efficiency for process exhaust gases which have a low level of combustible contaminants therein.

4 Claims, 1 Drawing Sheet

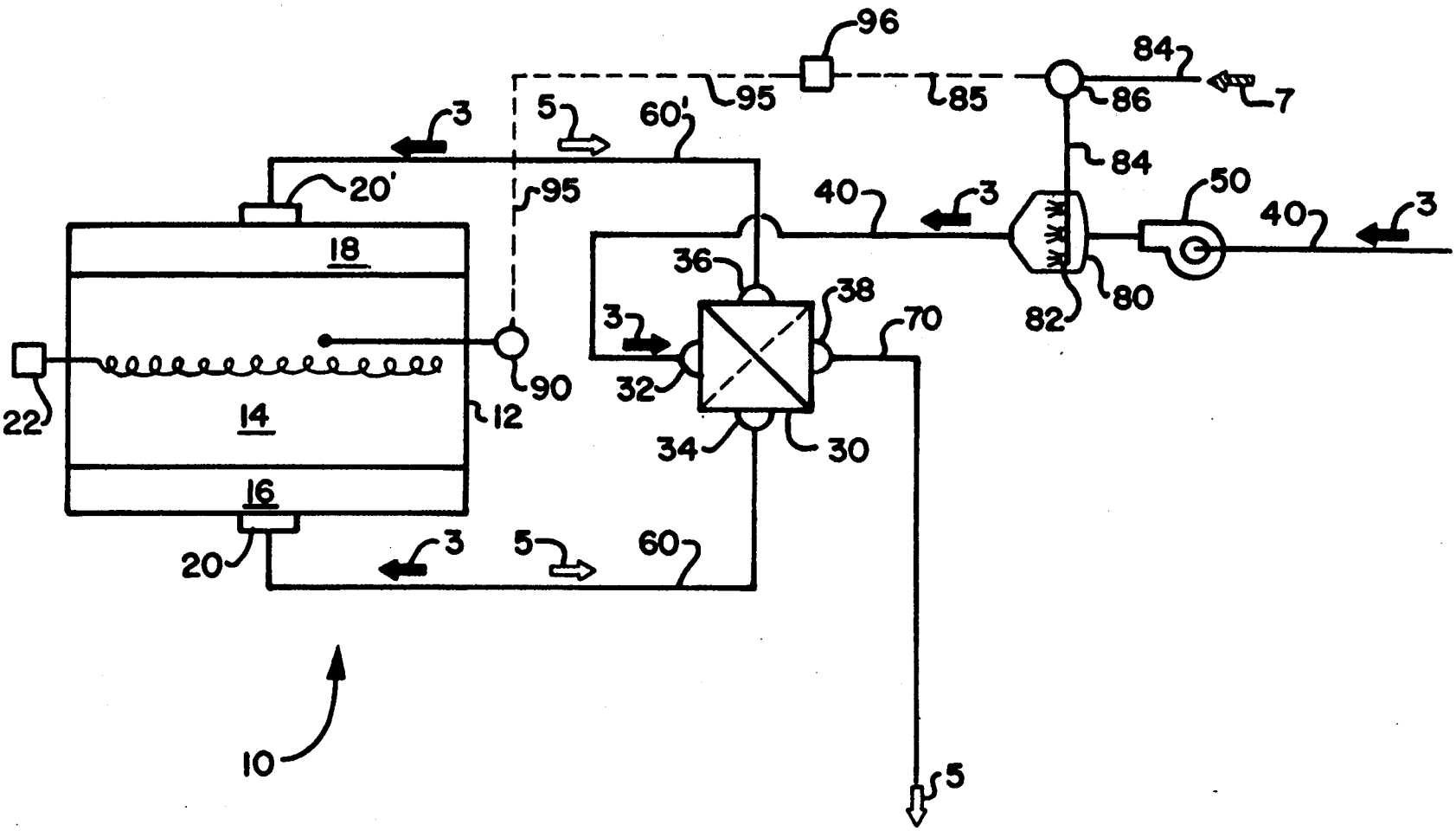
3
40
50
7
84
86
84
80
82
3
85
96
95
40
70
5
38
30
36
34
60'
32
60
3
5
95
90
5
12
3
3
20'
18
14
16
20
10
22

REGENERATIVE BED INCINERATOR SYSTEM WITH GAS DOPING

This is a Continuation of application Ser. No. 07/444,916, filed Dec. 4, 1989, now abandoned.

BACKGROUND OF THE INVENTION

The present invention relates generally to the regenerative incineration of solvents and other hydrocarbons in exhaust streams, and more particularly, to a regenerative bed, switching flow-type incinerator for processing waste gas/exhaust air with low hydrocarbon loadings.

Many manufacturing operations produce waste gases or exhaust air which include environmentally objectionable contaminants, generally combustible fumes such as solvents and other hydrocarbon substances, e.g., gasoline vapors, paint fumes, chlorinated hydrocarbons. The most common method of eliminating such combustible fumes prior to emitting the exhaust gases to the atmosphere is to incinerate the waste gas or exhaust air stream.

One method of incinerating the contaminants is to pass the waste gas or exhaust air stream through a fume incinerator prior to venting the waste gas or exhaust air stream into the atmosphere. An example of a suitable fume incinerator for incinerating combustible fumes in an oxygen bearing process exhaust stream is disclosed in U.S. Pat. No. 4,444,735. In such a fume incinerator, the process gas stream is passed through a flame front established by burning a fossil fuel, typically natural gas or fuel oil, in a burner assembly disposed within the incinerator. In order to ensure complete incineration of the combustible contaminants, all of the process exhaust stream must pass through the flame front and adequate residence time must be provided. Additionally, it is desirable to preheat the process exhaust stream prior to passing it through the flame front so as to increase the combustion efficiency. Of course, the cost of the heat exchanger to effectuate such preheating, in addition to the cost of the auxiliary fuel, render such fume incinerators relatively expensive.

Another type of incinerator commonly used for incinerating contaminants in process exhaust streams is the multiple-bed, fossil fuel-fired regenerative incinerator, such as, for example, the multiple-bed regenerative incinerators disclosed in U.S. Pat. Nos. 3,870,474 and 4,741,690. In the typical multiple-bed systems of this type, two or more regenerative beds of heat-accumulating and heat-transferring material are disposed about a central combustion chamber equipped with a fossil fuel-fired burner. The process exhaust stream to be incinerated is passed through a first bed, thence into the central combustion chamber for incineration in the flame produced by firing auxiliary fuel therein, and thence discharged through a second bed. As the incinerated process exhaust stream passes through the second bed, it loses heat to the material making up the bed. After a predetermined interval, the direction of gas flow through the system is reversed such that the incoming process exhaust stream enters the system through the second bed, wherein the incoming process exhaust stream is preheated prior to entering the central combustion chamber, and discharges through the first bed. By periodically reversing the direction of gas flow, the incoming process exhaust stream is preheated by absorbing heat recovered from the previously incinerated process exhaust stream, thereby reducing fuel consumption.

A somewhat more economical method of incinerating combustible contaminants, such as solvents and other hydrocarbon based substances, employing a single regenerative bed is disclosed in U.S. Pat. No. 4,741,690. In the process presented therein, the contaminated process exhaust stream is passed through a single heated bed of heat absorbent material having heat-accumulating and heat-exchanging properties, such as sand or stone, to raise the temperature of the contaminated process exhaust stream to the temperature at which combustion of the contaminants occurs, typically to a peak preheat temperature of about 900° C., so as to initiate oxidization of the contaminants to produce carbon-dioxide and water. Periodically, the direction of flow of the process exhaust stream through the bed is reversed. As the contaminants combust within the center of the bed, the temperature of the process exhaust stream rises. As the heated exhaust stream leaves the bed, it loses heat to the heat-accumulating material making up the bed and is cooled to a temperature about 20° C. to 25° C. above the temperature at which it entered the other side of bed. By reversing the direction of the flow through the bed, the incoming contaminated process exhaust stream is preheated as it passes that portion of the bed which has just previously in time been traversed by the post-combustion, hot process exhaust stream, thereby raising the temperature of the incoming process exhaust stream to the point of combustion by the time the incoming process exhaust stream reaches the central portion of the bed.

In the regenerative bed heat exchanger apparatus disclosed in U.S. Pat. No. 4,741,690, a heating means, typically an electric resistance heating coil disposed in the central portion of the bed, is provided to initially preheat the central portion of the bed to a desired temperature at which combustion of the contaminants in the process exhaust stream would be self-sustaining. When incinerating process gas streams with moderate or high hydrocarbon loadings, once steady state equilibrium conditions are reached, the electric resistance heating coil may usually be deactivated as the incoming process exhaust stream is adequately preheated and combustion is self-sustaining due to the gas switching procedure hereinbefore described.

However, when a process gas stream has a low concentration of combustible contaminants, i.e., a low hydrocarbon loading, there may be insufficient heat content liberated during incineration of the process gas stream to properly preheat the incoming process gas stream. That is, the BTU content of the incinerated process gas stream may be insufficient to heat the material in the downstream portion of the bed to the temperature at which combustion of the contaminants will occur. Accordingly, when treating such low hydrocarbon content process gas streams, it may be necessary to continuously supply current to the electric resistance heating coil disposed in the central portion of the bed so as to ensure that the bed material therein is maintained high enough to ensure that combustion of the insufficiently preheated process gases will be sustained. Unfortunately, due to the cost of electricity, it is uneconomical to incinerate low content process gas streams in such an electrically assisted regenerative bed incinerator.

SUMMARY OF THE INVENTION

The present invention provides an improved regenerative bed incinerator system of the electrically augmented type adapted to provide for the injection of controlled amounts of a gaseous fuel, such as natural gas, into the contaminated gas process stream being supplied to the incinerator as a means of increasing the BTU content of the contaminated process gas stream prior to incineration.

In accordance with the present invention the electrically assisted regenerative bed incinerator is provided with means for injecting a controlled amount of gaseous fuel, typically natural gas, into the incoming contaminated process exhaust gases at a point upstream of the bed, that is prior to admitting the process exhaust gases into the preheat side of the bed.

BRIEF DESCRIPTION OF THE DRAWING

The present invention will be better understood as described in greater detail hereinafter with reference to the sole FIGURE of the drawing which illustrates schematically a regenerative bed incinerator apparatus incorporating a system for the injection of selective amounts of gaseous fuel into the contaminated process exhaust gases prior to incineration.

DESCRIPTION OF A PREFERRED EMBODIMENT

Referring now to the drawing, there is depicted in the sole FIGURE thereof a regenerative bed incinerator 10 incorporating means for selectively injecting a controlled amount of gaseous fuel, such as natural gas, into the contaminated process exhaust gases prior to incineration so as to increase the overall BTU content of the process exhaust gases to be incinerated. It is to be understood that the term process exhaust gases as used herein refers to any process off-stream, be it waste gas or exhaust air, which is contaminated with combustible fumes of an environmentally objectionable nature including, without limitation, solvents, gasoline vapors, paint fumes, chlorinated hydrocarbons and other hydrocarbon substances, and which bears sufficient oxygen, in and of itself or through the addition of air thereto, to support combustion of the contaminants.

The regenerative bed incinerator 10 comprises a housing 12 enclosing a bed 14 of heat accumulating and heat transfer material, a lower gas plenum 16 disposed subadjacent to the bed 14, and an upper gas plenum 18 disposed superadjacent to the bed 14. Both the lower gas plenum 16 and the upper gas plenum 18 are provided with a gas flow aperture opening 20 and 20', respectively, which alternately serve as gas flow inlets or outlets depending upon the direction of gas flow through the bed, which as will be discussed further hereinafter is periodically reversed.

The bed 14 is comprised of particulate, heat-accumulating and heat-transfer material, such as sand or stone or other commercially available ceramic or metallic material which has the ability to absorb, store and exchange heat and which is sufficiently heat resistant so as to withstand without deterioration the combustion temperatures experienced within the bed. The particulate bed material is loosely packed within the bed 14 to provide sufficient void space within the bed volume such that the process exhaust gases may freely flow therethrough in either direction via a multiplicity of random and tortuous flow paths so that sufficient gas/-material contact is provided to ensure good heat transfer. The particular size of the bed material and gas flow velocity (i.e., pressure drop) through the bed is somewhat application dependent and will vary from case to case. Generally, the bed material will be greater than about two millimeters in its minimum dimension. The gas flow velocity through the bed 14 is to be maintained low enough to preclude fluidization of the particulate bed material.

An electric resistance heating coil 22, is embedded within the central portion of the bed 14. The heating coil 22 is selectively energized to preheat the material in the central portion of the bed 14 to a temperature sufficient to initiate and sustain combustion of the contaminants in the process exhaust gases, typically to a temperature of about 900° C. Preferably, once steady-state, self-sustaining combustion of the contaminants is attained, the heating coils 22 is deactivated. Although not generally necessary when incinerating moderate or high hydrocarbon content process exhaust gases, the heating coils 22 may be periodically reactivated, or even continuously activated at a low level, when incinerating low hydrocarbon content process exhaust gases to provide supplemental heat to the bed 14 to ensure self-sustaining combustion of the contaminants.

Both of the lower and upper gas plenums 16 and 18 are connected in flow communication to valve means 30 which is adapted to receive through the supply duct 40 from the fan 50 incoming process exhaust gases 3 to be incinerated at the first port 32 thereof and selectively direct the received process exhaust gases 3 through either the gas duct 60 which connects the opening 20 of the lower gas plenum 16 in flow communication to the second port 34 of the valve means 30 or the gas duct 60' which connects the opening 20' of the upper gas plenum 18 in flow communication to the third port 36 of the valve means 30. The fourth port 38 of the valve means 30 is connected to the exhaust duct 70 through which the incinerated process gas stream 5 is vented to the atmosphere.

At spaced intervals, typically every few minutes, valve means 30 is actuated to reverse the flow of gases through the bed 14. Thus, every few minutes the role of the lower and upper gas plenums 16 and 18 is reversed with one going from serving as an inlet plenum to serving as an outlet plenum for the incinerator 10, while the other goes from serving as an outlet plenum to serving as an inlet plenum for the incinerator 10. A few minutes later, their role is again reversed. In this manner, the upper and lower portions of the bed alternately absorb heat from the incinerated process exhaust gases leaving the central portion of the bed wherein most of the combustion of the contaminants occurs, and thence give up that recovered heat to incoming process exhaust gases being passed to the bed 14 for incineration.

With the valve means 30 in a first position, the incoming process exhaust gases 3 to be incinerated are directed through the first port 32 of the valve means 30 to the second port 34 thereof, thence through gas duct 60 to the lower gas plenum 16 to pass upwardly therefrom through the lower portion of the bed 14 wherein the process exhaust gases are preheated, thence through the central portion of the bed 14 wherein the contaminants therein are incinerated, thence through the upper portion of the bed 14 wherein the incinerated process exhaust gases are cooled by transferring heat to the bed material in the upper portion of the bed, and thence passes into the upper gas plenum 18. The incinerated process exhaust gases 5 are thence passed therefrom through the gas duct 60' to the third port 36 of the valve means 30 and are thence directed through the fourth port 38 of the valve means 30 to the exhaust duct 70 for venting to the atmosphere.

With the valve means 30 in a second position, the incoming process exhaust gases 3 to be incinerated are directed through the first port 32 of the valve means 30 to the third port 36 thereof, thence through gas duct 60' to the upper gas plenum 18 to pass downwardly therefrom through the upper portion of the bed 14 wherein the process exhaust gases are preheated, thence through the central portion of the bed 14 wherein the contaminants therein are incinerated, thence through the lower portion of the bed 14 wherein the incinerated process exhaust gases are cooled by transferring heat to the bed material in the lower portion of the bed, and thence pass into the lower gas plenum 16. The incinerated process exhaust gases 5 are thence passed therefrom through the gas duct 60 to the second port 34 of the valve means 30 and are thence directed through the fourth port 38 of the valve means 30 to the exhaust duct 70 for venting to the atmosphere.

As noted previously, when incinerating a contaminated process exhaust gas stream having a low hydrocarbon content, the heat liberated during combustion of the hydrocarbons in the process exhaust gas stream is insufficient for proper operation of the regenerative bed incineration system. That is, the peak temperature generated during combustion of such a low hydrocarbon content, ergo low BTU content, process exhaust gas stream is too low to ensure complete incineration of the contaminants within the bed. Additionally, there is insufficient heat content within the incinerated process exhaust gases to adequately heat the downstream bed material to ensure proper preheating of the incoming process exhaust gases during the next cycle.

In accordance with the present invention the electrically assisted regenerative bed incinerator 10 is provided with means for injecting a controlled amount of gaseous fuel, typically natural gas, into the incoming contaminated process exhaust gases 3 at a point upstream of the bed 14, that is prior to admitting the process exhaust gases 3 into the preheat side of the bed 14. Preferably, the means for injecting a controlled amount of gaseous fuel into the incoming process exhaust gases 3 comprises gas injection means 80 for introducing gaseous fuel 7 into the incoming process exhaust gases 3, temperature sensing means 90 for monitoring the temperature of the central portion of the bed 14 and transmitting a signal indicative of the sensed temperature of the central portion of the bed 14, and controller means 96 operatively associated with the gas injection means 80 for controlling the amount of gaseous fuel 7 introduced into the contaminated process exhaust gases 3 via the gas injection means 80.

Most advantageously, the gas injection means 80 is disposed in operative association with the process exhaust gas supply duct 40 so as to introduce the gaseous fuel into the incoming process exhaust gases 3 as it passes through the gas supply duct 40 at a location upstream of the gas switching means or valve means 30 and downstream of the fan 50. Typically, the gas injection means 80 comprises a series of injection nozzles 82 disposed across the cross-sectional flow area of gas supply duct 40 and connected in flow communication via a supply line 84 to a gaseous fuel supply control valve 86 which in turn is connected in flow communication to a supply of gaseous fuel (not shown). The control valve 86 is adapted to selectively open and close in response to a control signal 85 received from the controller means 96 so as to selectively regulate the amount of gaseous fuel 7 passing through supply line 84 to the nozzles 82 of the gas injection means 80 for introduction into the process exhaust gases 3 passing through the gas supply duct 40.

The temperature sensing means 90 operatively associated with the bed 14 monitors the temperature of the central portion of the bed 14, generates a signal 95 indicative of the measured temperature, and transmits the signal 95 to the controller means 96 which functions to regulate the control valve 86 of the gas injection means 80. Preferably, the temperature sensing means 90 comprises a thermocouple disposed within the central portion of the bed 14 and electrically connected to the controller means 96.

The controller 96 compares the measured bed temperature as indicated by the signal 95 received from the temperature sensing means 90 to a set point temperature which represents a preselected bed temperature considered adequately high enough to ensure complete combustion within the bed 14 of the contaminants in the process exhaust gases 3 and sufficient preheating of the incoming process exhaust gases 3 within the gas preheating portion of the bed 14. When the measured bed temperature drops below this set point temperature, the controller 96 generates and transmits a control signal 85 to the control valve 86 which causes the control valve 86 to open so as to pass gaseous fuel 7 from the gaseous fuel supply (not shown) through the supply line 84 to the injection nozzles 82 for introduction into the incoming process exhaust gases 3. The control valve 86 thereafter remains open and gaseous fuel 7 is continuously introduced into the process exhaust gases 3 until the temperature of the central portion of the bed 14 is again raised above the level that ensures adequate preheating of the incoming process exhaust gases 3 within the gas preheating portion of the bed 14 and subsequently substantially complete combustion of the contaminants in the process exhaust gases 3 within the bed 14, that is above the set point temperature.

In the preferred mode of operation, the controller 96 functions to modulate the degree of openness of the control valve 86 so as to selectively regulate the amount of gaseous fuel 7 being introduced into the process exhaust gases 3 passing through the gas supply duct 40 so as to maintain the measured temperature at or near the preselected set point temperature. Ergo, the further the measured temperature is below the preselected set point temperature, the further the controller 96 will open the control valve 86 to allow a greater amount of gaseous fuel 7 to pass into the process exhaust gases 3. As the measured temperature recovers and approaches the set point, the controller 96 will begin to reduce the openness of the control valve 86 thereby reducing the amount of gaseous fuel 7 introduced into the process exhaust gases.

It is to be understood that for process exhaust gases of particularly low heating value, i.e., hydrocarbon content, it may be necessary to continuously introduce a certain amount of gaseous fuel 7 into the process exhaust gases 3 so as to increase the heating value of the process exhaust gases to a level that will sustain the desired bed temperature as represented by the set point temperature. In such a case, the controller 96 will modulate the openness of the control valve 86 in response to the measured temperature as indicated by the received temperature signal 95. If the measured temperature drops below the set point, the controller 96 will further open the control valve 86 in proportion to the amount by which the measured temperature drops below the set point and, conversely, if the measured temperature raises above the set point, the controller 96 will reduce the openness of the control valve 86 in proportion to the amount by which the measured temperature exceeds the set point temperature.

I claim:

1. A method of operating a regenerative bed incinerator system in order to thereby effect the combustion of combustible contaminants contained in a process exhaust gas comprising the steps of:

a. providing an incinerator containing at least one gas permeable bed of particulate material having heat-accumulating and heat-exchanging properties;

b. supplying a flow of process exhaust gas containing combustible contaminants having a predetermined BTU content;

c. alternately directing the flow of process exhaust gas containing combustible contaminants having a predetermined BTU content to and through the permeable bed of the incinerator in opposite, alternate directions so as to periodically reverse the direction of flow through the permeable bed of the incinerator of the process exhaust gas containing combustible contaminants having a predetermined BTU content;

d. initially heating the permeable bed of the incinerator to a preestablished temperature sufficient to initiate self-sustained combustion of the combustible contaminants having a predetermined BTU content contained in the process exhaust gas during the course of the passage thereof through the permeable bed of the incinerator;

e. terminating the initial heating of the permeable bed of the incinerator when the temperature of the permeable bed of the incinerator has attained the preestablished temperature sufficient to initiate self-sustained combustion of the combustible contaminants contained in the process exhaust gas during the course of the passage thereof through the permeable bed of the incinerator;

f. sensing the temperature of the permeable bed of the incinerator;

g. generating a signal whenever the temperature of the permeable bed of the incinerator is sensed to be at a temperature below the preestablished temperature that is sufficient to initiate self-sustained combustion of the combustible contaminants having a predetermined BTU content contained in the process exhaust gas during the course of the passage thereof through the permeable bed of the incinerator;

h. initiating, in response to the generation of a said signal, injection of additional combustible material into the flow of process exhaust gas containing combustible contaminants having a predetermined BTU content prior to the introduction thereof into the incinerator in order to thereby increase the BTU content of the process exhaust gas such that the heat generated from combustion during the passage of the flow of process exhaust gas through the permeable bed of the incinerator is sufficient to raise the temperature of the permeable bed of the incinerator once again to the preestablished temperature sufficient to initiate self-sustained combustion of the combustible contaminants having a predetermined BTU content contained in the process exhaust gas during the course of the passage thereof through the permeable bed of the incinerator; and i. terminating the injection of the additional combustible material into the flow of process exhaust gas containing combustible contaminants having a predetermined BTU content when the temperature of the permeable bed of the incinerator is sensed to be once again at the preestablished temperature sufficient to initiate self-sustained combustion of the combustible contaminants having a predetermined BTU content contained in the process exhaust gas during the course of the passage thereof through the permeable bed of the incinerator.

2. The method of operating a regenerative bed incinerator system as set forth in claim 1 wherein the initial heating of the permeable bed of the incinerator to the preestablished temperature sufficient to initiate self-sustained combustion of the combustible contaminants having a predetermined BTU content contained in the process exhaust gas during the course of the passage thereof through the permeable bed of the incinerator is accomplished through electrical heating.

3. The method of operating a regenerative bed incinerator system as set forth in claim 1 wherein the preestablished temperature of the permeable bed of the incinerator sufficient to initiate self-sustained combustion of the combustible contaminants having a predetermined BTU content contained in the process exhaust gas during the course of the passage thereof through the permeable bed of the incinerator is 900° C.

4. The method of operating a regenerative bed incinerator system as set forth in claim 1 wherein the additional combustible material injected into the flow of process exhaust gas is gaseous fuel.

* * * * *